US007226346B2

(12) United States Patent
Walker et al.

(10) Patent No.: US 7,226,346 B2
(45) Date of Patent: Jun. 5, 2007

(54) SANDING APPARATUS

(75) Inventors: Andrew Walker, Newton Hall (GB); Tim McKay, Ashington (GB)

(73) Assignee: Black & Decker Inc., Newark, DE (US)

( * ) Notice: Subject to any disclaimer, the term of this patent is extended or adjusted under 35 U.S.C. 154(b) by 63 days.

(21) Appl. No.: 10/925,319

(22) Filed: Aug. 24, 2004

(65) Prior Publication Data

US 2005/0272356 A1 Dec. 8, 2005

(30) Foreign Application Priority Data

Jun. 7, 2004 (EP) ..... 04253395

(51) Int. Cl.
*B24B 21/00* (2006.01)

(52) U.S. Cl. ..... 451/296; 451/355

(58) Field of Classification Search ..... 451/355, 451/344, 351, 352, 356, 451, 358, 360, 296
See application file for complete search history.

(56) References Cited

U.S. PATENT DOCUMENTS

| | | | | |
|---|---|---|---|---|
| 1,523,151 | A | 1/1925 | Wilsbach | |
| 2,178,865 | A | 11/1939 | Swan | |
| 2,280,867 | A | 4/1942 | Swan | |
| 3,334,447 | A | 8/1967 | Leveque | |
| 3,359,689 | A | 12/1967 | McCarty et al. | |
| 3,793,781 | A * | 2/1974 | Hutchins | 451/356 |
| 4,118,897 | A | 10/1978 | Martin | |
| 5,545,077 | A | 8/1996 | Boeck et al. | |
| 6,174,226 | B1 | 1/2001 | Frech et al. | |
| 6,379,236 | B1 | 4/2002 | Takizawa | |
| 6,419,569 | B1 | 7/2002 | Frech et al. | |
| 6,475,075 | B1 | 11/2002 | Wuensch | |
| 6,565,425 | B1 * | 5/2003 | Wuensch | 451/309 |
| 7,018,280 | B2 * | 3/2006 | Walker | 451/355 |

FOREIGN PATENT DOCUMENTS

| | | |
|---|---|---|
| DE | 1690005 | 4/1971 |
| DE | 7 718 737 | 10/1977 |
| DE | 3031877 | 4/1982 |
| DE | 3 117 785 | 11/1982 |
| DE | 38 23 392 | 1/1990 |
| DE | 3 919 651 | 12/1990 |
| DE | 3715 292 | 11/1998 |
| DE | 19720691 | 11/1998 |
| DE | 10200489 | 7/2003 |

(Continued)

*Primary Examiner*—Jacob K. Ackun, Jr.
(74) *Attorney, Agent, or Firm*—Bruce S. Shapiro; John Yun; Wesley W. Muller

(57) ABSTRACT

A belt sander (2) comprising a housing (4) and having a lower sanding surface (40) and an upper sanding surface (42) opposite the first sanding is disclosed. The sander has a larger rear roller (32) driven by a motor (22), a front roller (34) of smaller diameter than the rear roller, and an endless sanding belt (38). A guard (48) is pivotable between a lowered position preventing access to the upper sanding surface and a raised position allowing access to the upper sanding surface. A handle (12) on the housing is pivotable between a first handle position adjacent the upper sanding surface and at least one second handle position further from the upper sanding surface than the first handle position.

34 Claims, 17 Drawing Sheets

FOREIGN PATENT DOCUMENTS

| | | |
|---|---|---|
| EP | 0 611 632 | 8/1994 |
| EP | 0 573826 | 1/1997 |
| EP | 1 013 376 | 12/1999 |
| GB | 2 321 610 | 8/1998 |
| JP | 10202493 | 1/1998 |
| JP | 2000 280157 | 10/2000 |

* cited by examiner

SANDING APPARATUS

FIELD OF THE INVENTION

The present invention relates to sanding apparatus, and relates particularly, but not exclusively, to belt sanders for sanding wooden floors.

BACKGROUND OF THE INVENTION

Belt sanders are known in which an endless abrasive sanding belt passes around a driving roller and a driven roller, and the driving roller is rotated by means of a toothed belt driven by a motor to cause the sanding belt to move over a generally flat base surface located between the driving and driven rollers.

U.S. Pat. No. 6,174,226 discloses a handheld belt sander which has opposed first and second sanding surfaces.

JP 2000-280157 discloses a belt sander which provides a pivotable cover which selectively prevents access to an upper sanding surface of the sander. However, this arrangement suffers from the disadvantage that the accuracy with which sanding can be carried out is limited, for a given size of sander.

Preferred embodiments of the present invention seek to overcome the above disadvantages of the prior art.

BRIEF SUMMARY OF THE INVENTION

According to the present invention, there is provided a sanding apparatus comprising:

a housing defining a first base surface and a second base surface opposite said first base surface;

at least one first roller and at least one second roller, wherein at least one said first roller has a diameter larger than a diameter of at least one said second roller;

a motor for driving at least one said first roller for causing an endless abrasive belt passing around at least one said first roller and at least one said second roller in use to move across said first and second base surfaces to define first and second sanding surfaces respectively;

at least one guard member moveable between a first guard position preventing access to said second sanding surface and at least one second guard position allowing access to said second sanding surface; and at least one handle on said housing, wherein at least one said handle is moveable between a first handle position adjacent said second sanding surface and at least one second handle position further from said second sanding surface than said first handle position.

By providing a sander having at least one first roller and at least one second roller of smaller diameter than the first roller, this provides the advantage of enabling accurate sanding operations to be carried out for a given size of sander, while the provision of a movable guard member provides a further sanding surface which may be selectively accessible.

At least one said guard member may be pivotable between said first and second guard positions thereof.

At least one said handle may be pivotable relative to said housing between first and second handle positions thereof.

The apparatus may further comprise locking means for preventing movement of at least one said handle from a second handle position thereof to said first handle position when at least one said guard member is in a said second guard position thereof, and/or for preventing movement of at least one said guard member to a second guard position thereof when at least one said handle is in a first handle position thereof.

The locking means may comprise linkage means interconnecting at least one said handle and at least one said guard member such that movement of at least one said handle to the first handle position thereof causes movement of at least one said guard member to the first guard position thereof.

The locking means may comprise at least one linkage member adapted to engage a respective handle to prevent movement of said handle relative to the housing to said first handle position when a predetermined said guard member is in the second guard position thereof.

At least one said linkage member may comprise a respective protrusion and/or slot adapted to engage a corresponding slot and/or protrusion on a respective said handle.

The locking means may comprise at least one linkage member adapted to engage at least one guard member to prevent movement of said guard member to said second guard position thereof when a said handle is in said first handle position thereof.

At least one said linkage member may comprise a respective recess and/or protrusion for engaging a corresponding protrusion and/or recess on at least one said guard member.

At least one said linkage member may be pivotable relative to the housing between a first position allowing movement of at least one said guard member to a second guard position thereof and a second position preventing movement of said guard member to said second guard position, wherein movement of said linkage member to said first position is prevented when said handle is in a first handle position thereof.

A plane defined by said first base surface may be substantially tangential to a predetermined said second roller.

By arranging a predetermined said second roller to be substantially tangential to a plane defined by the first base surface, this provides the advantage that the limit of the region sanded by the sanding apparatus is now defined by the bottom of the predetermined second, as opposed to the edge of the base surface, as a result of which the region which cannot be sanded by the present invention is as wide as the radius of the predetermined second roller, whereas this region in the prior art is at least as wide as the whole diameter of one of the rollers. As a result, the present invention has the advantage that sanding much closer to the edge of a floor can be carried out.

The spacing of said predetermined second roller from said first base surface may be adjustable.

This provides the advantage of enabling the tension in the belt to be adjusted.

The predetermined second roller and a base portion defining said first base surface may include cooperating engaging means for enabling said predetermined second roller to slide relative to said first base surface.

This provides the advantage of providing a simple means of adjusting the spacing between the predetermined second roller and the first base surface, while maintaining the predetermined second roller tangential to the plane defined by the first base surface.

The predetermined second roller may be displaceable towards said first base surface to facilitate mounting and/or removal of said endless belt.

A first said roller located furthest from the or each said second roller may be substantially tangential to said second base surface but not to said first base surface.

The apparatus may further comprise a third base surface substantially coplanar with said first base surface, and an inlet between said first and third base surfaces for enabling the endless belt to pass through said inlet and around said first roller located furthest from the or each said second roller.

In a preferred embodiment, the motor is located in use on a side of the endless belt remote from said first base surface and an output shaft of said motor is substantially parallel to an axis of rotation of a first said roller adapted to be driven by said motor.

By providing the motor on a side of the endless belt remote from the first base surface and an output shaft of said motor substantially parallel to an axis of rotation of a first said roller adapted to be driven by said motor, this provides the advantage of enabling the apparatus to be constructed more compactly. For example, by passing a toothed belt around gears connected to the ends of the motor output shaft and the first roller axis, the motor does not need to be laterally offset relative to the sanding belt, as a result of which the width of the apparatus is only slightly larger than that of the sanding belt.

The apparatus may further comprise a drive belt connected between an output shaft of said motor and a said first roller.

BRIEF DESCRIPTION OF THE DRAWINGS

A preferred embodiment of the invention will now be described, by way of example only and not in any limitative sense, with reference to the accompanying drawings, in which.

DETAILED DESCRIPTION OF THE INVENTION

Figure 1:
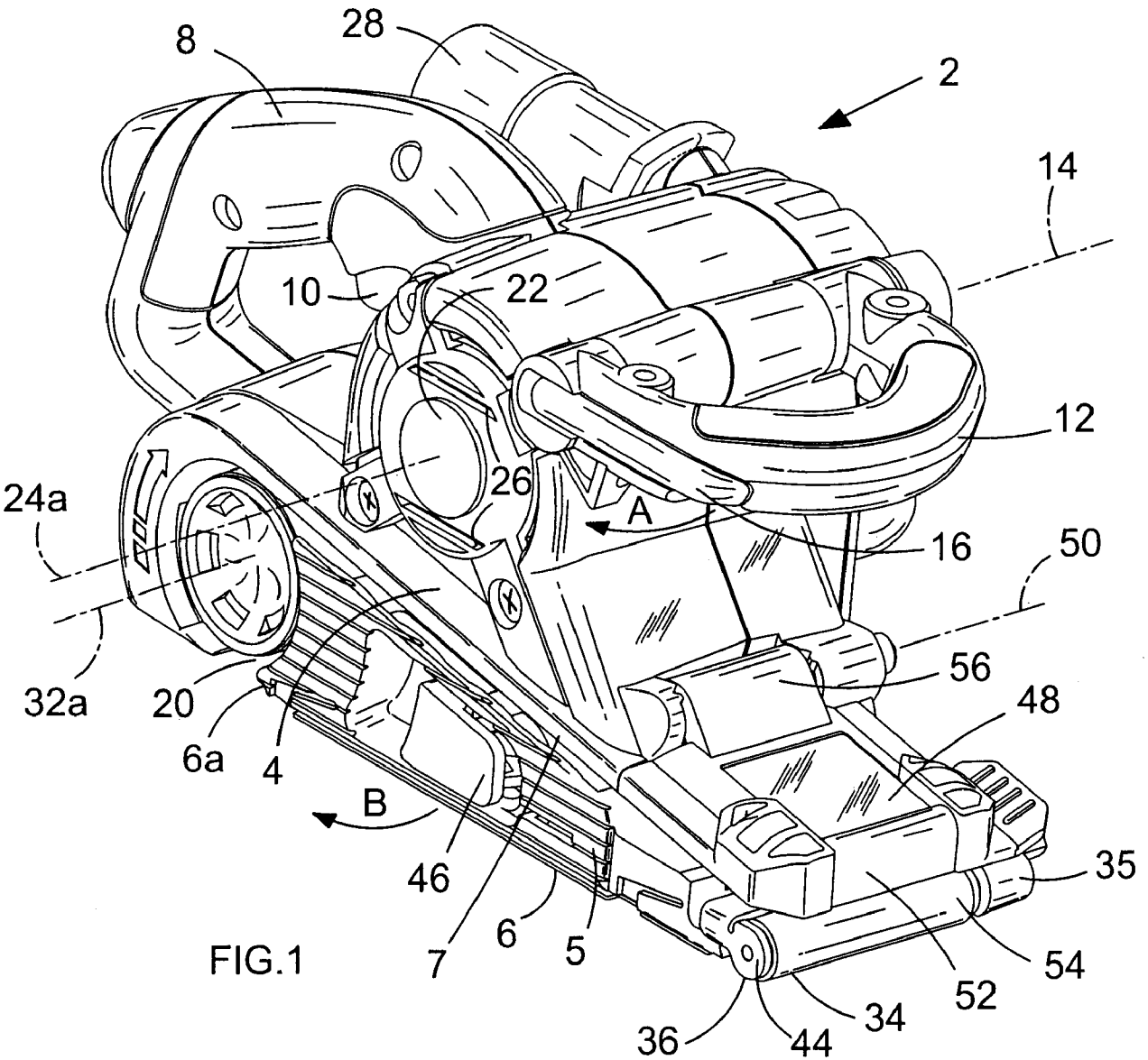
FIG. 1 is a perspective view of a sander embodying the present invention from the front and a first side with a guard in a lowered position.

A belt sander 2 has a housing 4 of durable plastics material and having a generally wedge shaped base portion 5 defining a generally flat base surface 6 and a rear handle 8 having a trigger 10. Flat base surface 6 may comprise a separate metal plate attached to base portion 5. A power cable (not shown) extends from the handle 8 for supplying electrical power to the sander 2. A forward handle 12 is pivotable about pivot axis 14 relative to the housing 4 and is lockable in selected angular positions relative to the housing by means of a locking lever 16 which is pivoted outwardly of the housing 4 in the direction of arrow A (FIG. 1) to release the handle 12 and is pivoted inwardly to lock the handle 12. Pivot axis 14 extends substantially transversely to a vertical plane containing the major axis of sander 2 and base portion 5. (The major axis extends horizontally (left to right) on the page of FIG. 2 and the vertical plane containing the axis extends perpendicularly to the page in FIG. 3.) In particular, the handle 12 is provided with suitable engaging means, which will be familiar to persons skilled in the art, which locate the handle 12 at selected angular positions about pivot axis 14. The lever 16 can operate in a number of possible ways, for example by means of cooperating cam surfaces. This enables the user to choose the most ergonomic position of the handle 12 for the particular task.

The housing 4 also defines a duct 18 (FIG. 9) connecting an inlet 20 in the base 5 of the housing with a motor 22 having an output shaft 24 which also carries a fan (not shown). The fan displaces air radially outwardly through an outlet 28 into a dust bag (not shown). The fan is surrounded by a closely fitting flange to divide the space occupied by the fan into a clean air chamber axially separated from a dirty air chamber. Air drawn into the clean air chamber through air inlets 26 in one or both sides of the housing 4 cools the motor, while air is drawn into the dirty air chamber through inlet 20 via duct 18, and all of the air drawn into the fan is expelled through outlet 28. As a result, dust produced by the sanding operation is drawn through inlet 20 and expelled into the dust bag, in a manner described in greater detail below.

Housing 4 includes cylindrical motor receiving chamber 41 disposed at a location between the locations of front roller 34 and rear roller 32 taken along a major axis of sander 2. Chamber 41 is disposed at a higher vertical position than both rollers 32 and 34. Motor 22 is received within chamber 41. The output shaft 24 of the motor 22 is rotatable about axis 24*a* which is substantially transverse to the major axis and carries a gear 25 for driving a toothed belt 30 (FIG. 10) which passes around a gear 33 mounted to a rear roller 32 arranged in a lower part of the housing 4 above inlet 20. The gear 33 is rotatable about axis 32*a* and has larger diameter than the gear 25, which enables the rotational speed of the rear roller 32 to be chosen. The axes 24*a* and 32*a* are generally parallel to each other, which enables the motor 22 to be located above the base portion 5 and laterally in line therewith, which in turn enables compact construction of the sander. A front roller 34, having smaller diameter than the rear roller 32, is arranged in the lower part of the housing such that a lowermost point 36 of the front roller is in line with the base surface 6. The front roller 34 is of concave cross-section to assist in retaining in position an endless sanding belt 38 (FIG. 9) which passes around the front 34 and rear 32 rollers and across the base surface 6 to define a lower sanding surface 40 and an upper sanding surface 42.

Front roller 34, rear roller 32 and base 5 jointly define a path for receiving belt 38 of standard size, that is, having a width of seventy five mm (usually expressed as three inches) transverse to the major axis and having a perimeter of either eighteen or twenty one inches. The rear roller 32 is generally tangential to an upper surface 7 of wedge shaped base portion 5, but is offset relative to the flat base surface 6, as a result of which the direction of belt 38 changes as it passes around rear edge 6*a* of base surface 6, so that the belt 38 is asymmetrically arranged relative to a line joining the central axes of front and rear rollers 34, 32. Housing 4 includes an undersurface 43 which extends at a forwardly downwardly inclined angle from a location above rear roller 32 towards front roller 34. The overall inclination angle of undersurface 43 may be ten degrees relative to the horizontal.

Figure 2:
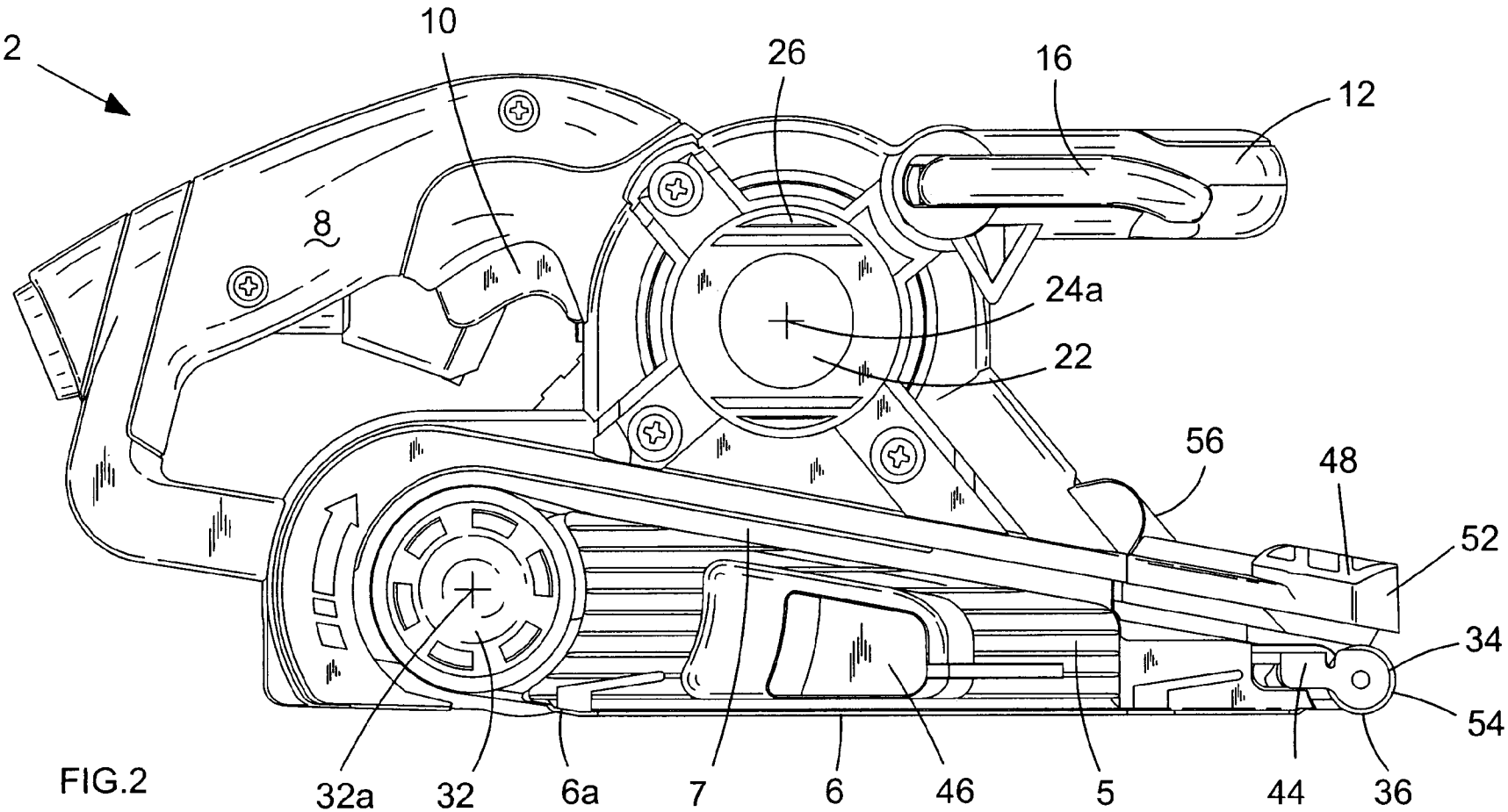
FIG. 2 is an elevation view of the sander of FIG. 1 from the first side.
Figure 3:
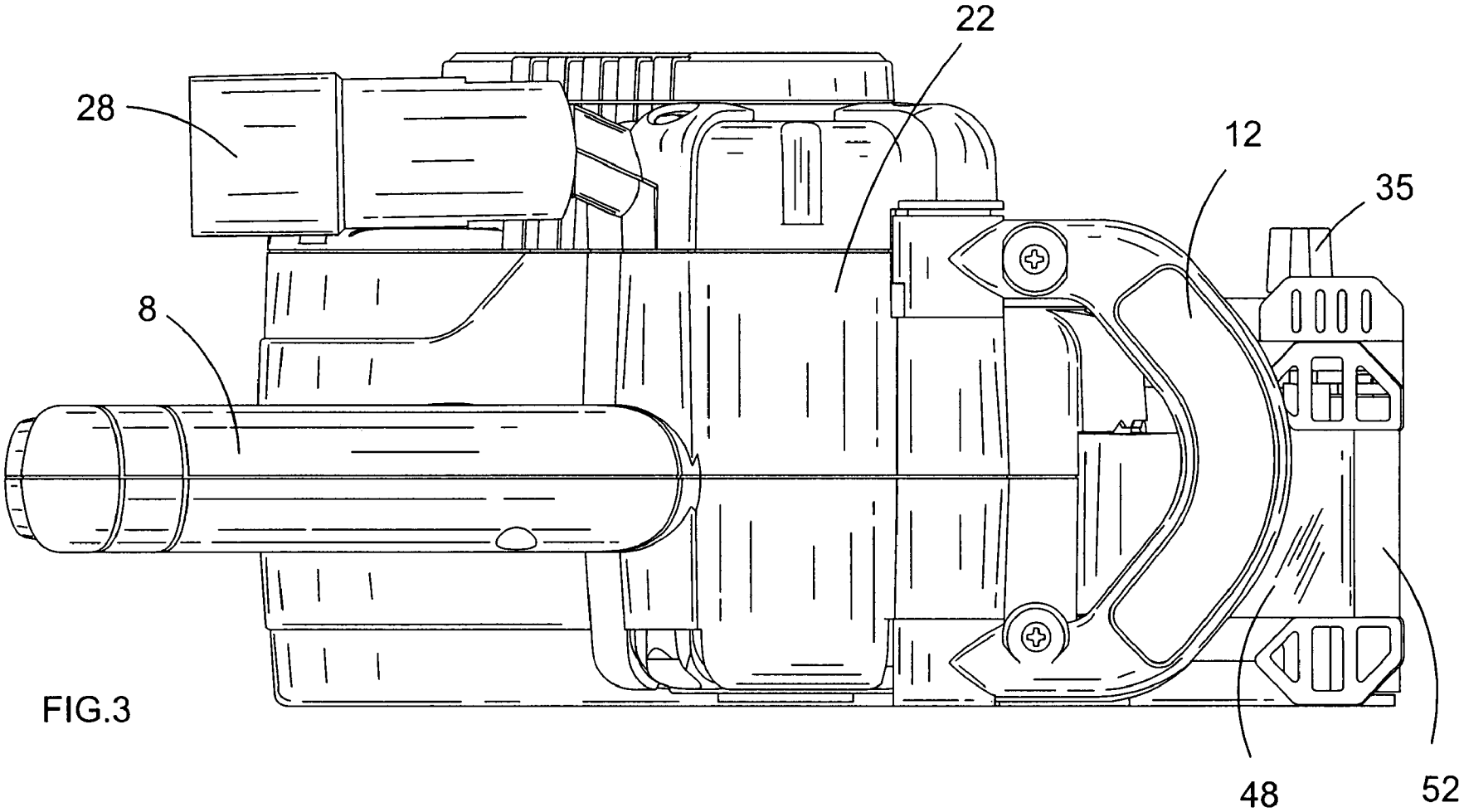
FIG. 3 is a top view of the sander of FIG. 1.
Figure 4:
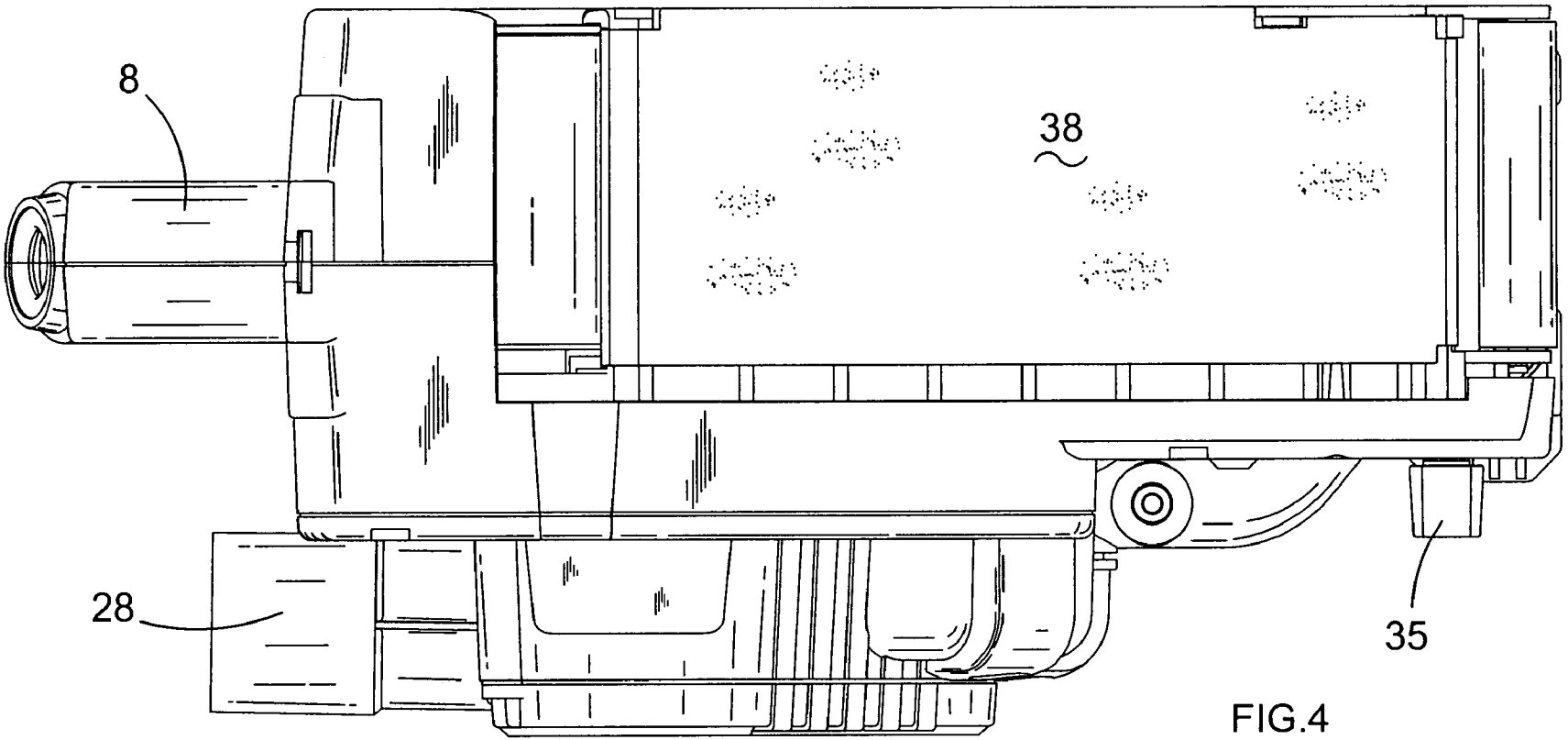
FIG. 4 is a bottom view of the sander of FIG. 1.
Figure 5:
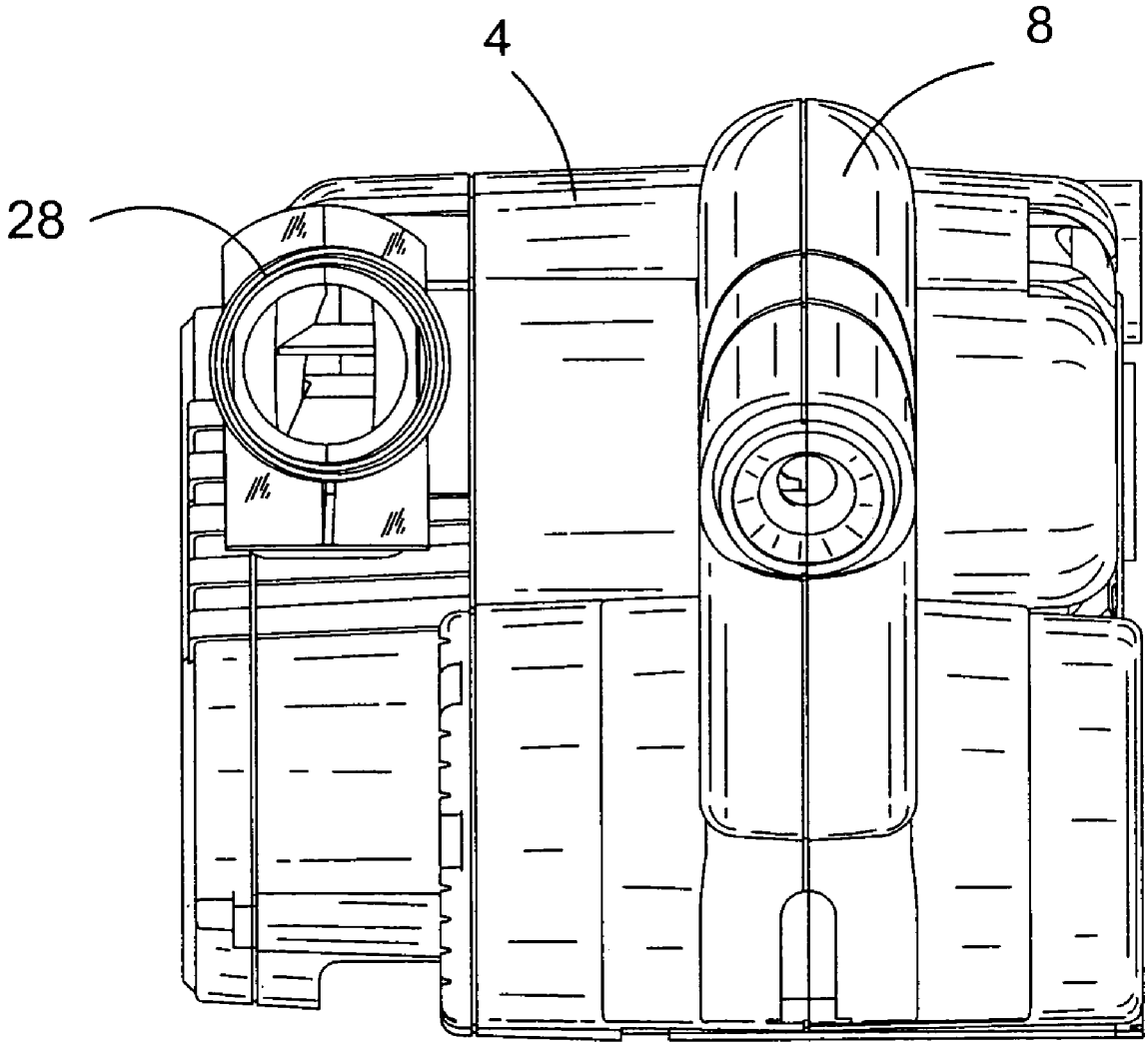
FIG. 5 is a rear view of the sander of FIG. 1.
Figure 6:
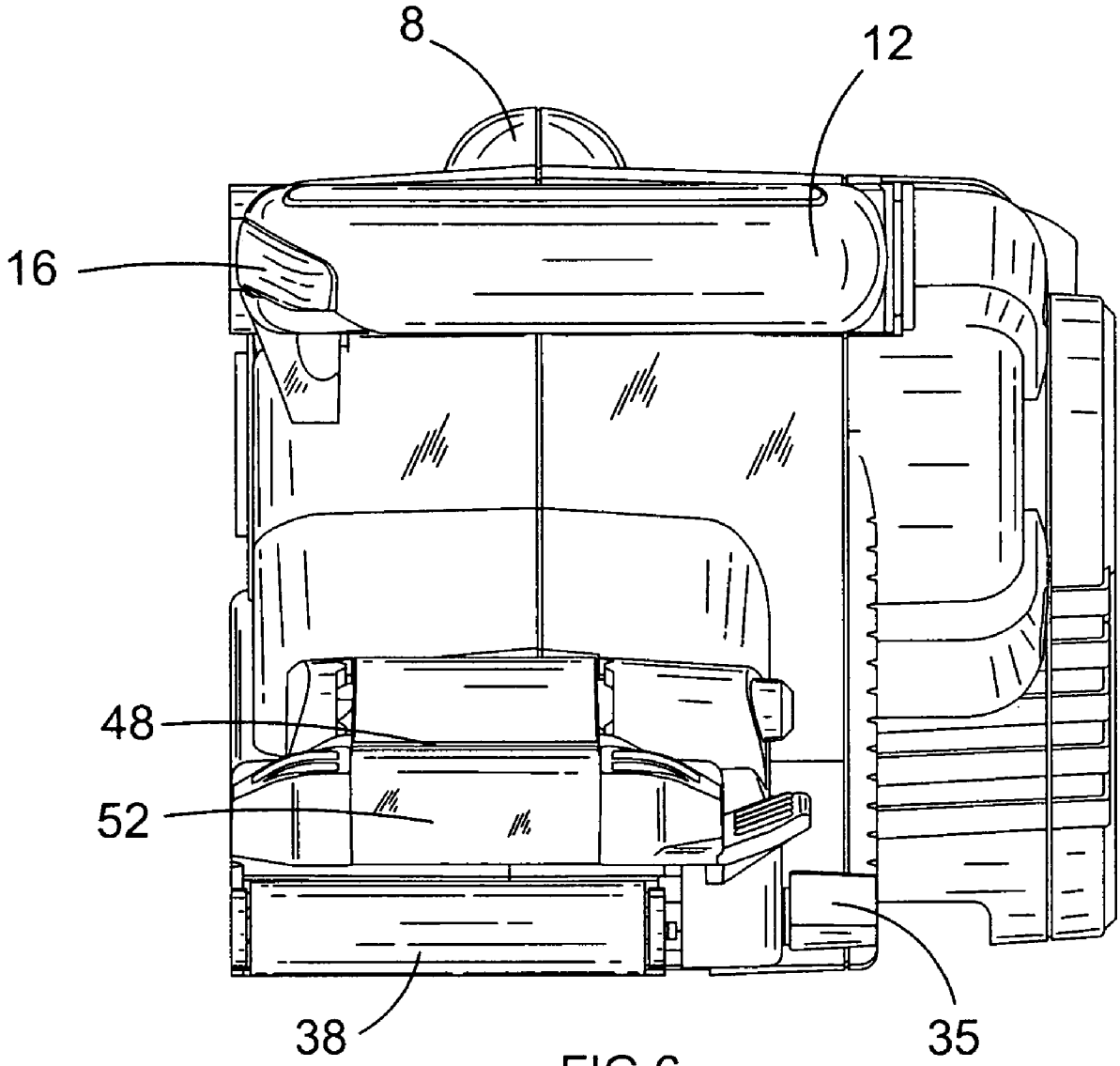
FIG. 6 is a front view of the sander of FIG. 1.
Figure 7:
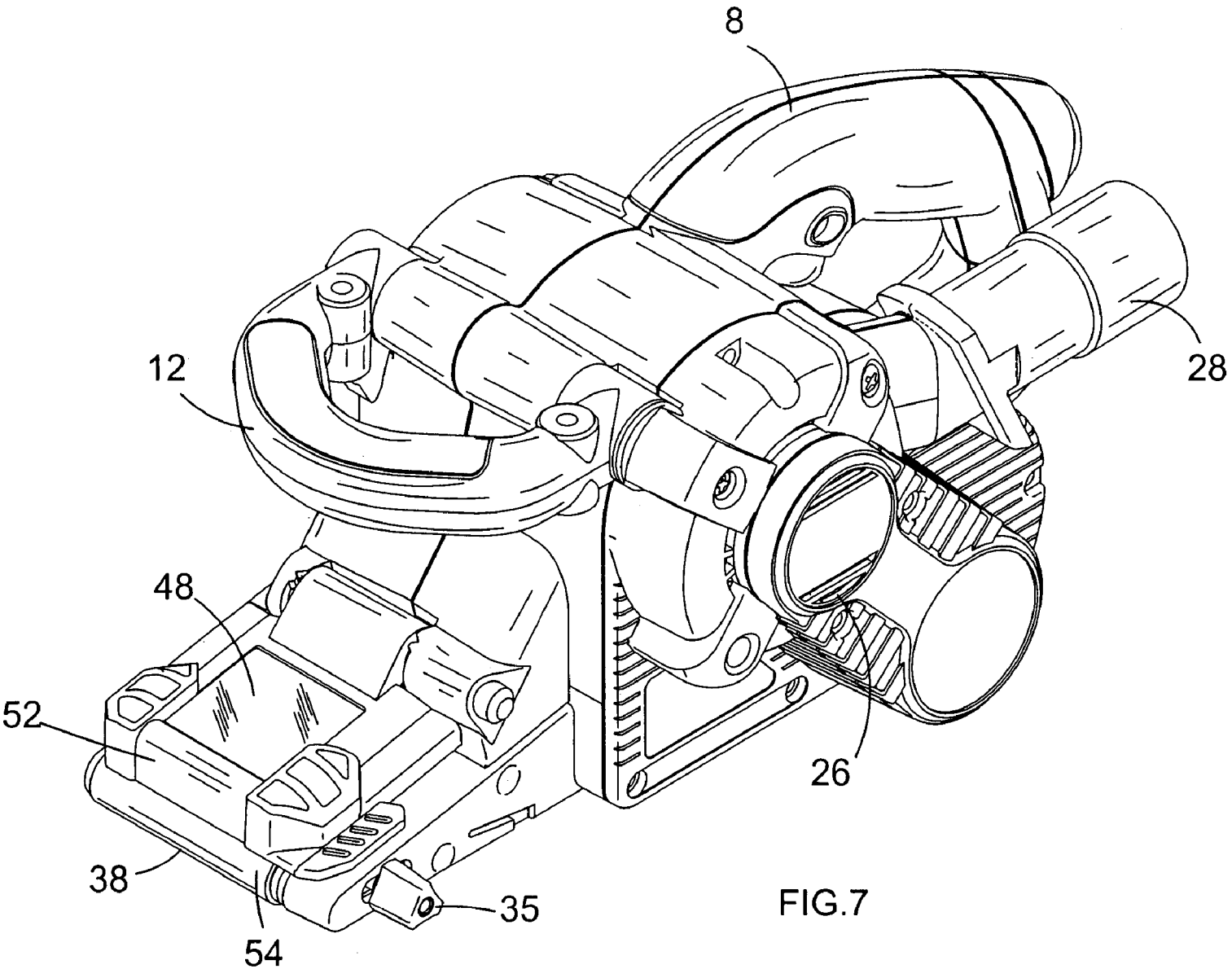
FIG. 7 is a perspective view from the front and a second side of the sander of FIG. 1.
Figure 8:
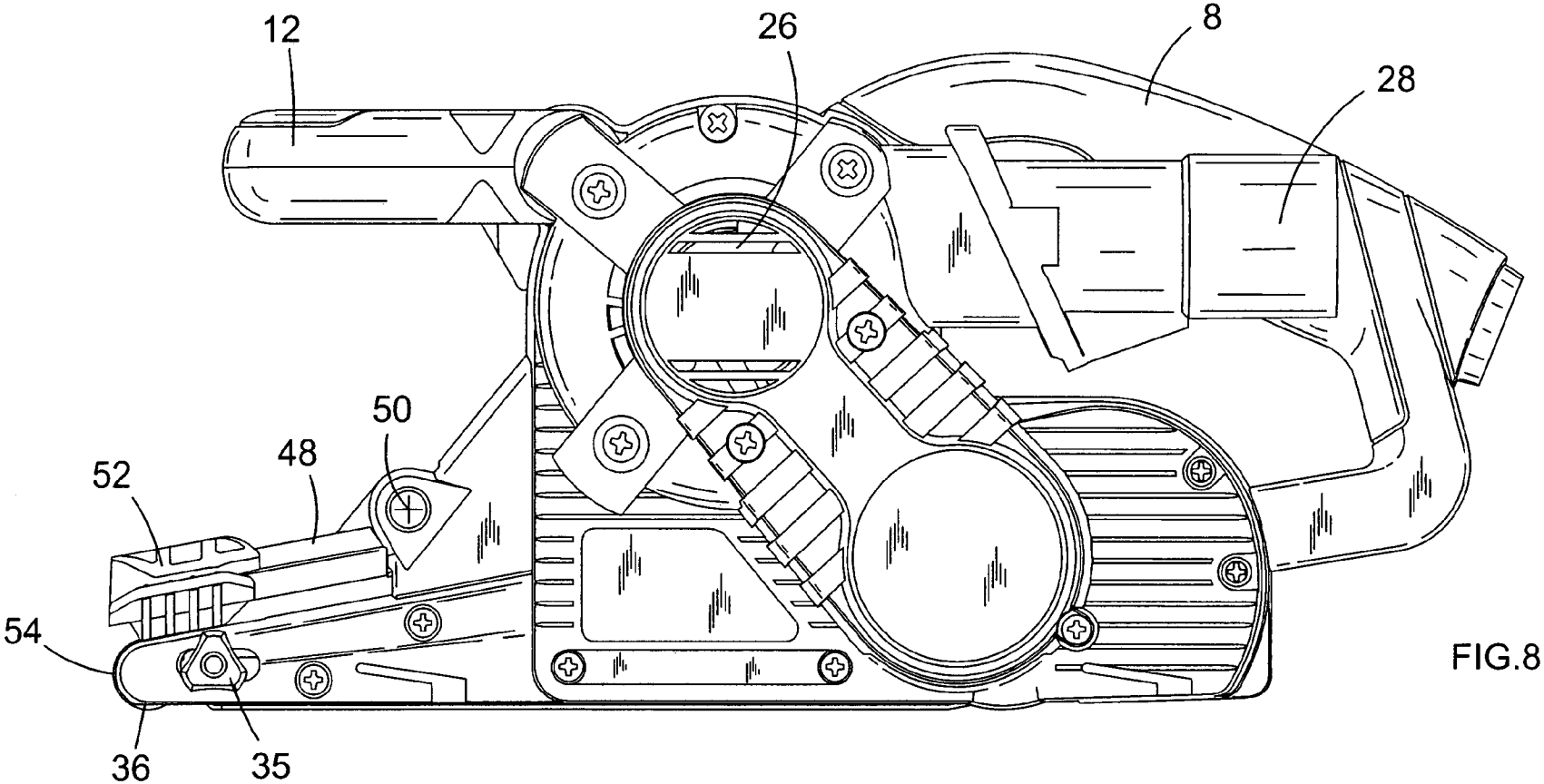
FIG. 8 is an elevation view from the second side of the sander of FIG. 1.

With reference to FIGS. 1 and 2, the gripping surface of handle 12 is curved and is located generally within a plane which extends in a direction transverse to the major axis of sander 2. Handle 12 is secured to an upper portion of motor receiving chamber 41, at a location between the locations of front roller 34 and rear roller 32 taken along a major axis of sander 2. Like chamber 41, handle 12 is disposed at a higher vertical position than both rollers 32 and 34.

The front roller 34 is slidably mounted to the front of the base part 5 of the housing 4 by means of a support 44, and the support 44 is urged forwardly by a compression spring (not shown) to maintain the tension in the sanding belt 38. A lever 46 on the base part 5 of the housing can be pivoted outwards in the direction of arrow B shown in FIG. 1 to place the spring under compression by means of a cam surface to enable the support 44 to be moved inwardly to remove the sanding belt 38 for replacement or for adjustment. The front roller 34 is also provided with an adjustment knob 35 for adjusting the angle of the longitudinal axis of the roller 34 relative to the housing 34.

The upper sanding surface 42 is covered by a guard 48 which is pivotable relative to the housing about an axis 50 between a lower position and an upper position. In the lower position the guard 48 covers the upper sanding surface 42 and prevents access to it and a front portion 52 of the guard extends forwardly of forwardmost part 54 of the sanding belt 38. In the upper position of the guard 48, access to the upper sanding surface 42 is permitted, for example for sanding the underside of objects such as tables, or for sanding non-level surfaces such as door frames.

Figure 9:
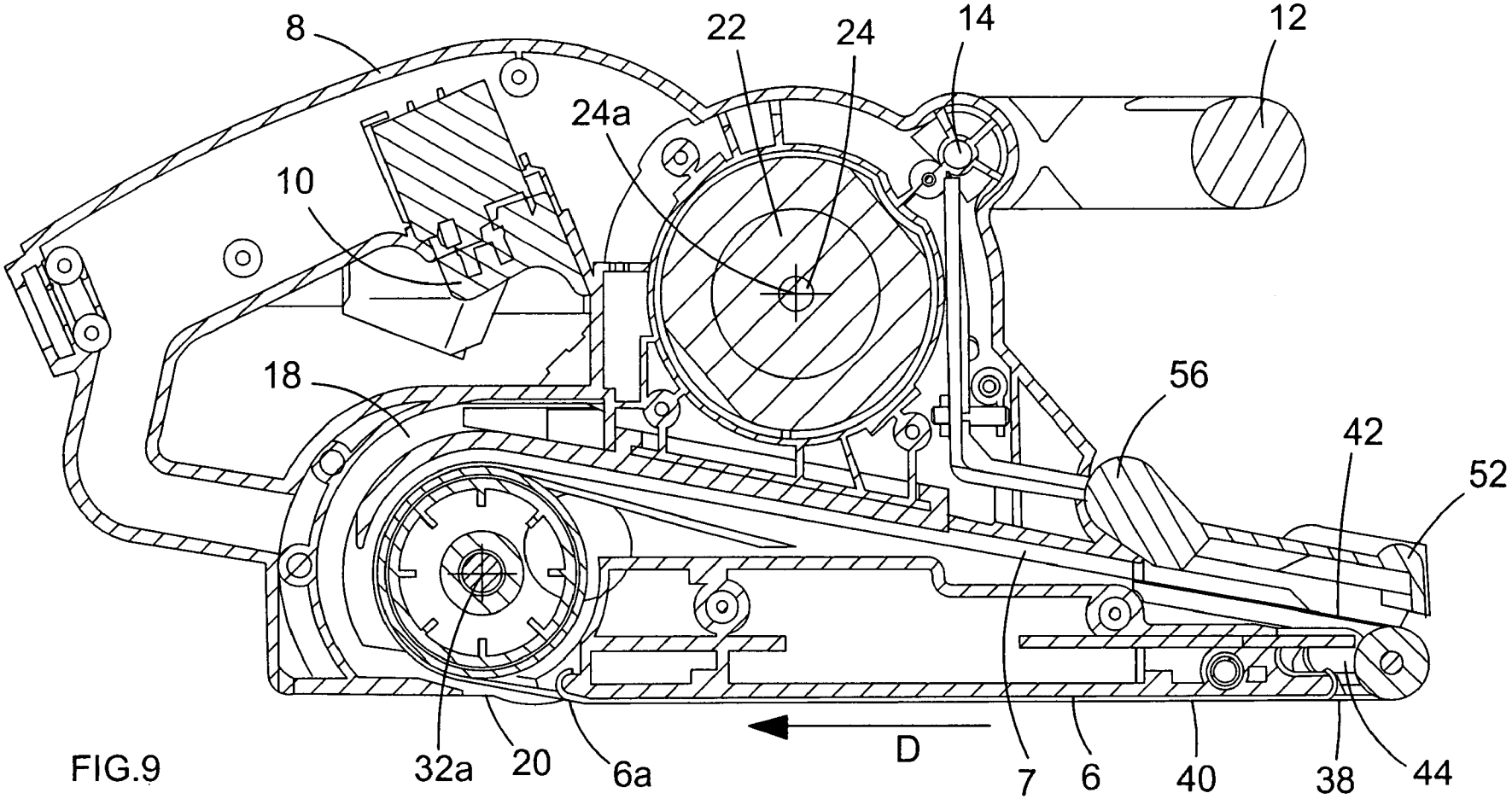
FIG. 9 is a cross sectional elevation view of the sander of FIG. 1 from a first side.
Figure 10:
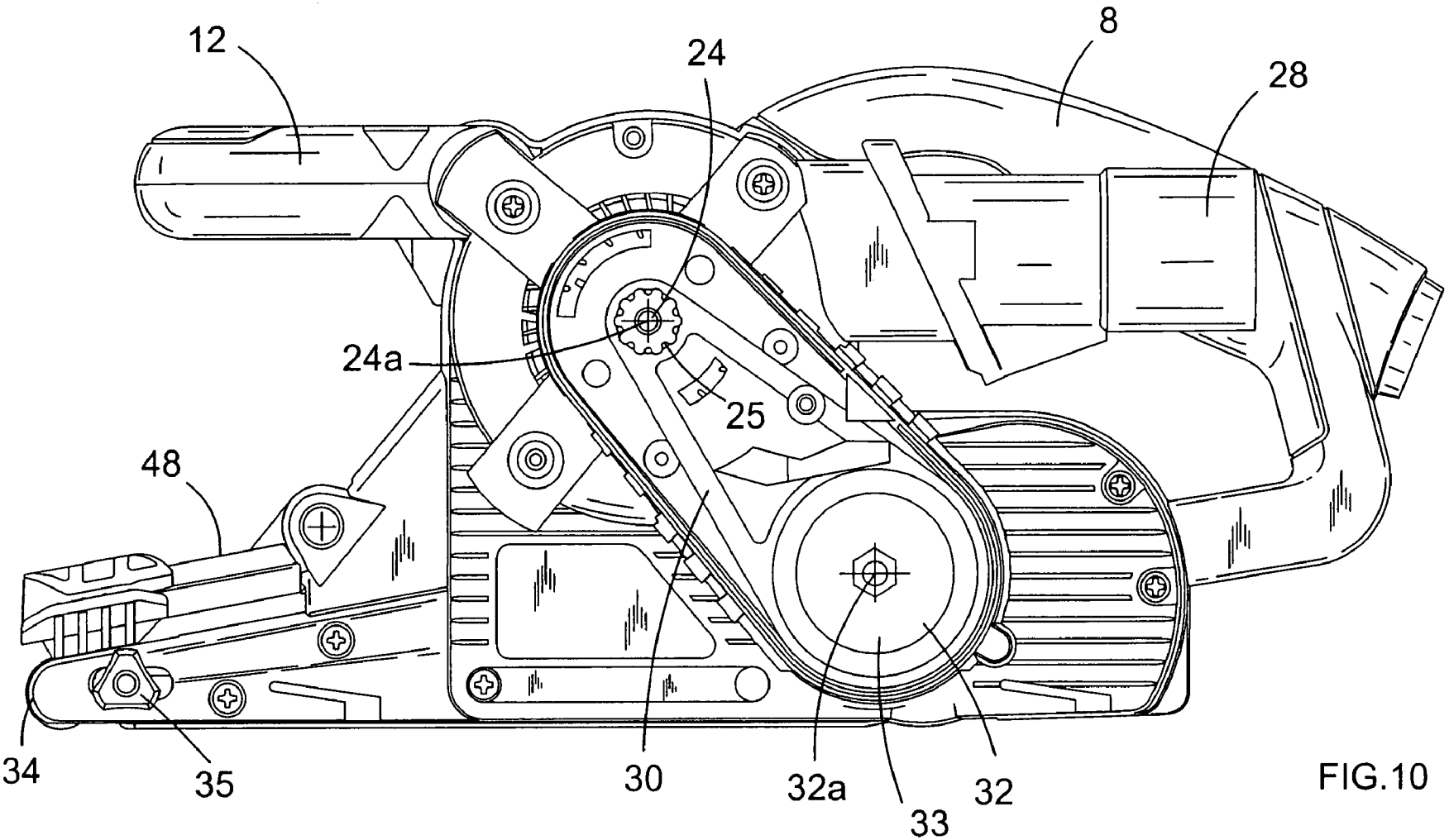
FIG. 10 is a cross sectional elevation view of the sander of FIG. 1 from a second side.
Figure 11:
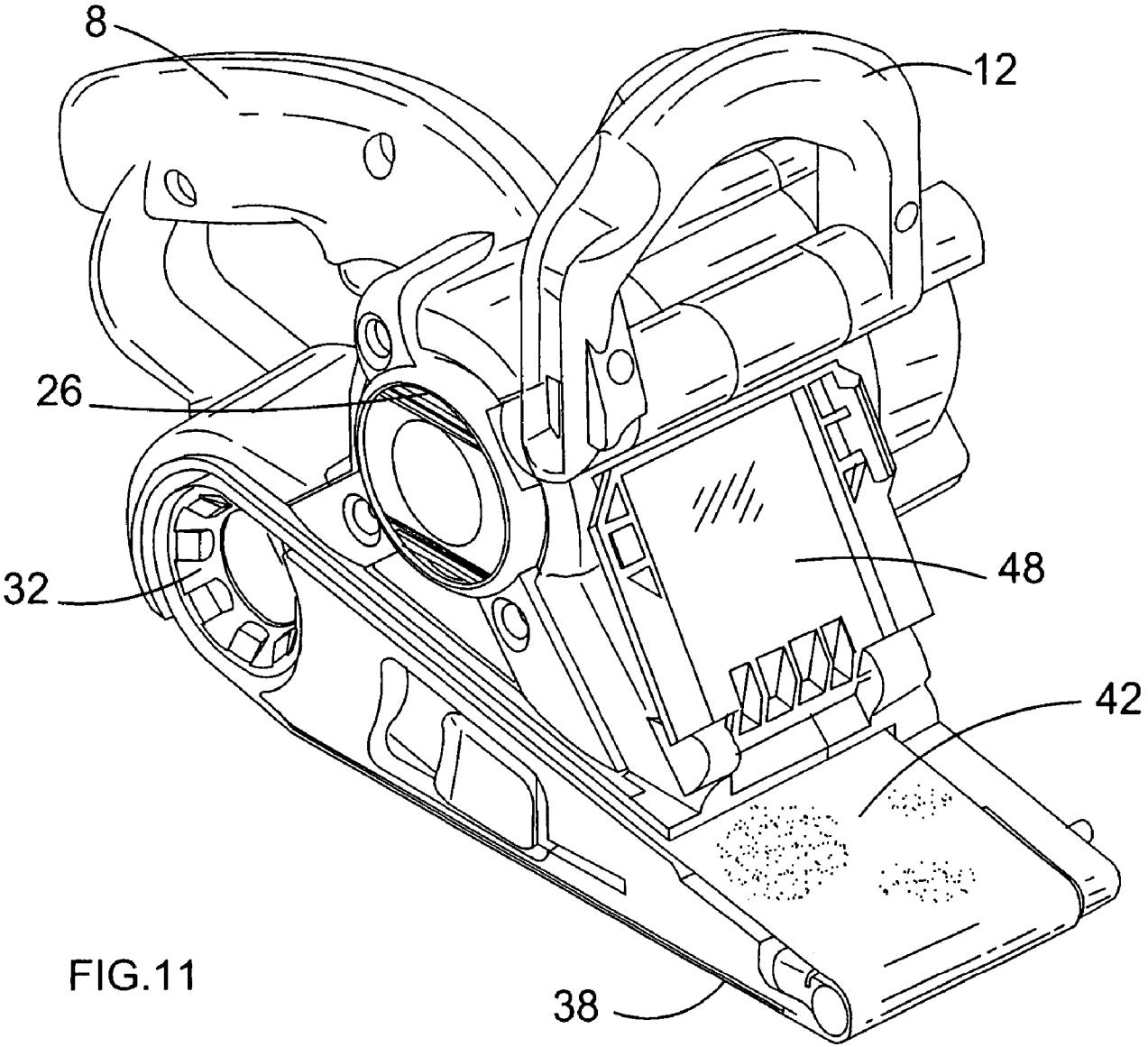
FIG. 11 is a view, corresponding to FIG. 1, of the sander with the guard and handle thereof in a raised position.
Figure 12:
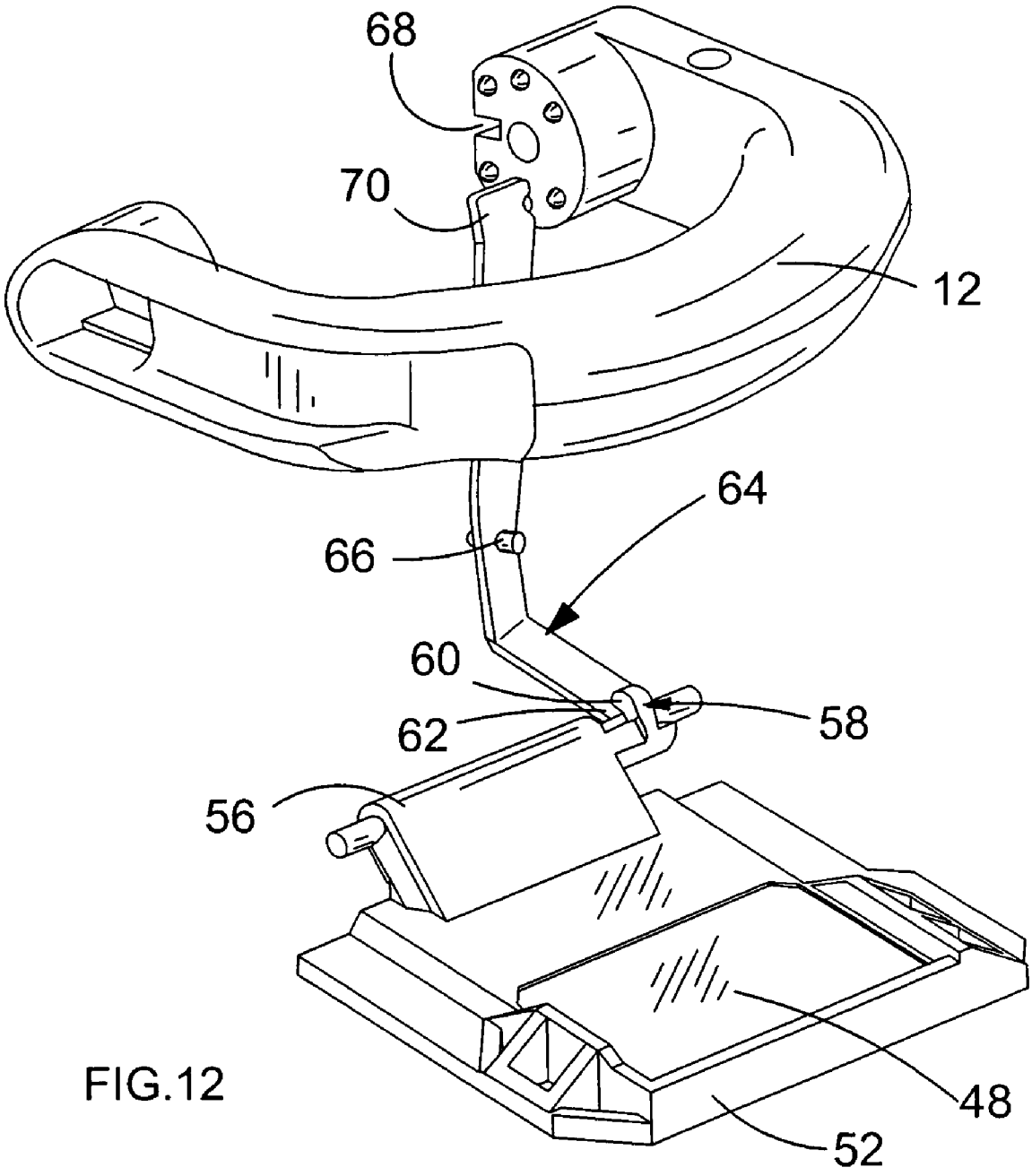
FIG. 12 is a perspective view of a handle, guard and locking mechanism of the sander of FIG. 1, with the guard and handle in a lower position.
Figure 13:
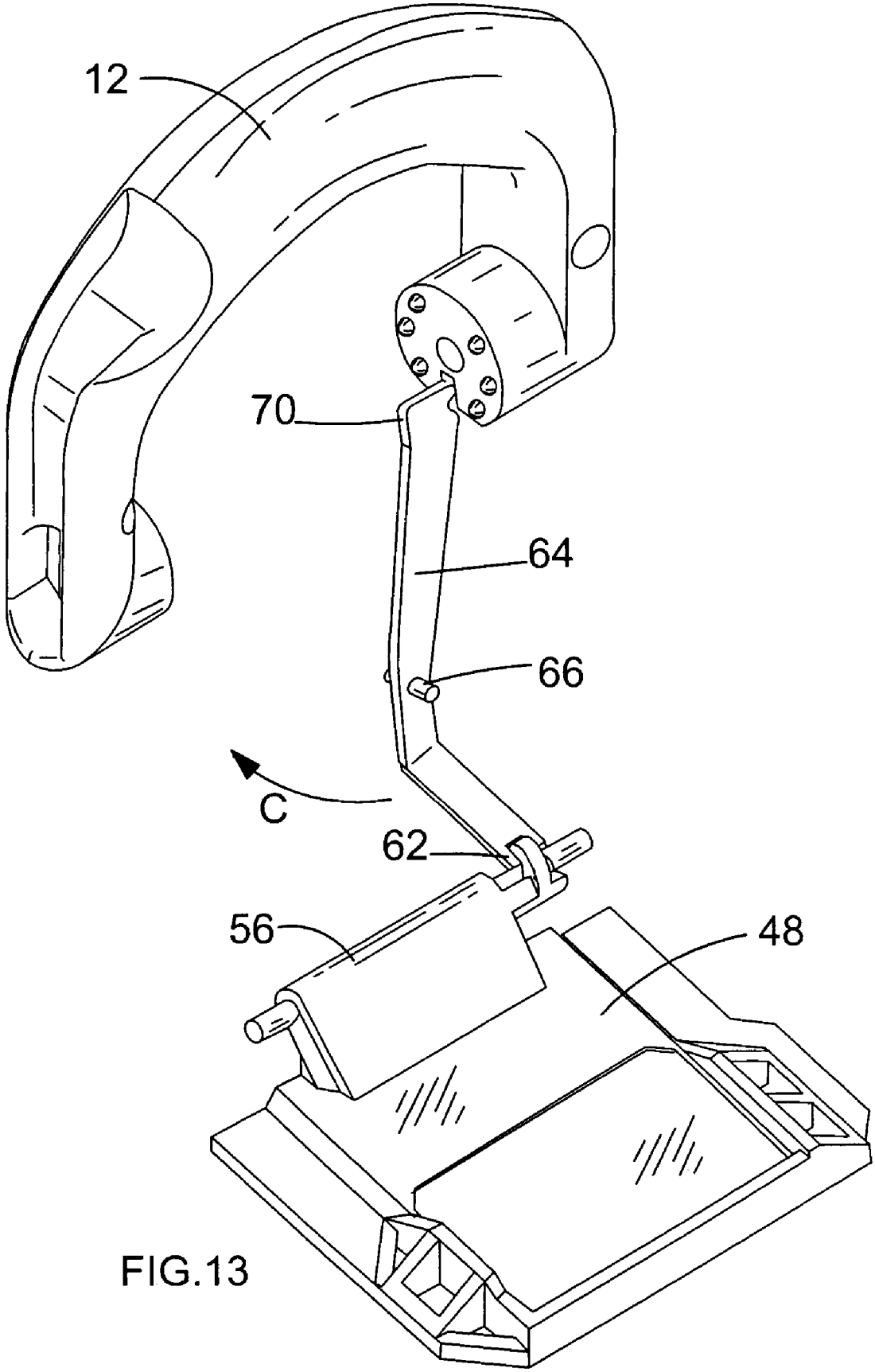
FIG. 13 is a view, corresponding to FIG. 12, with the handle in a raised position.
Figure 14:
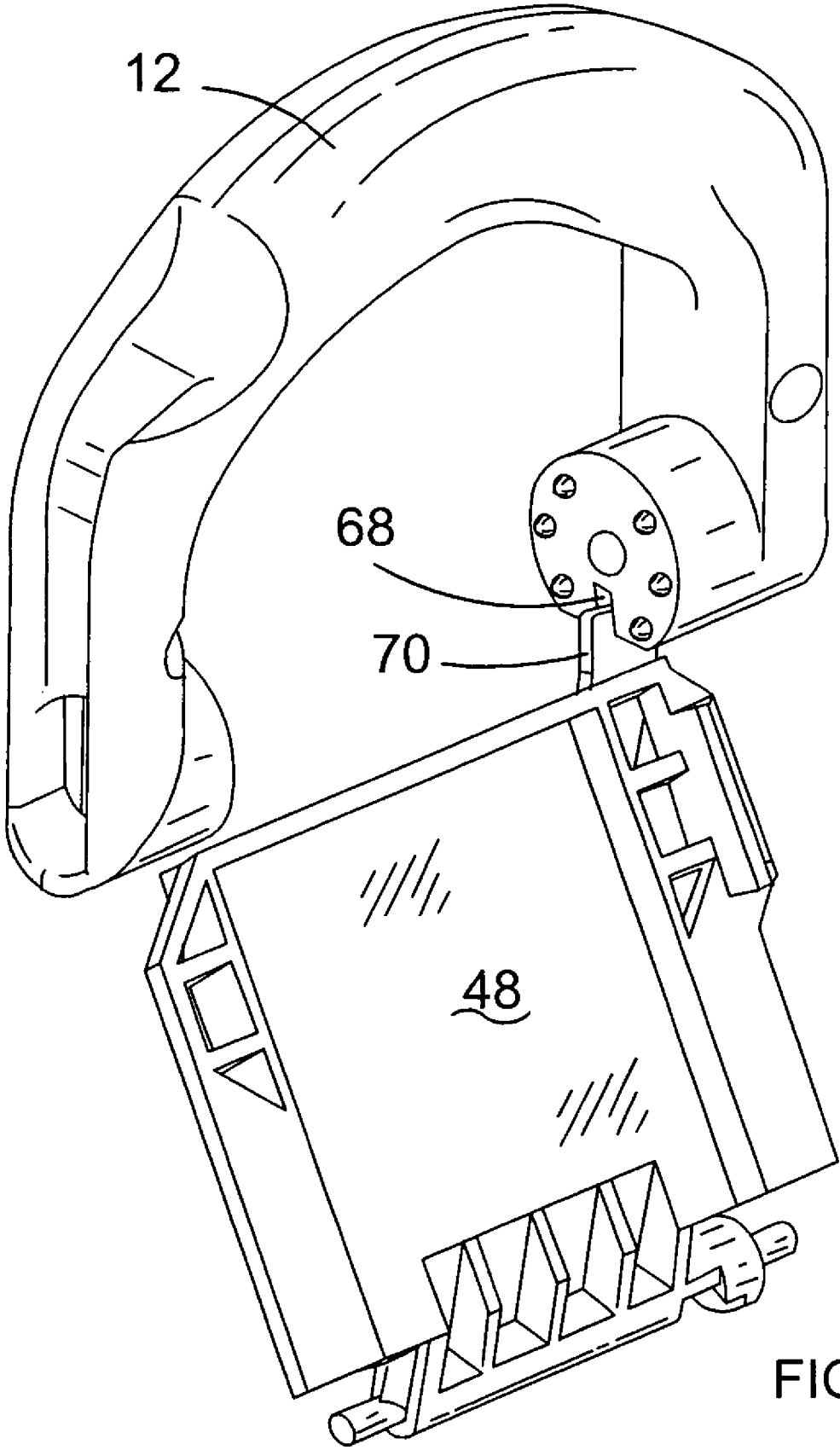
FIG. 14 is a view, corresponding to FIG. 12, with the handle and guard in raised positions.
Figure 15:
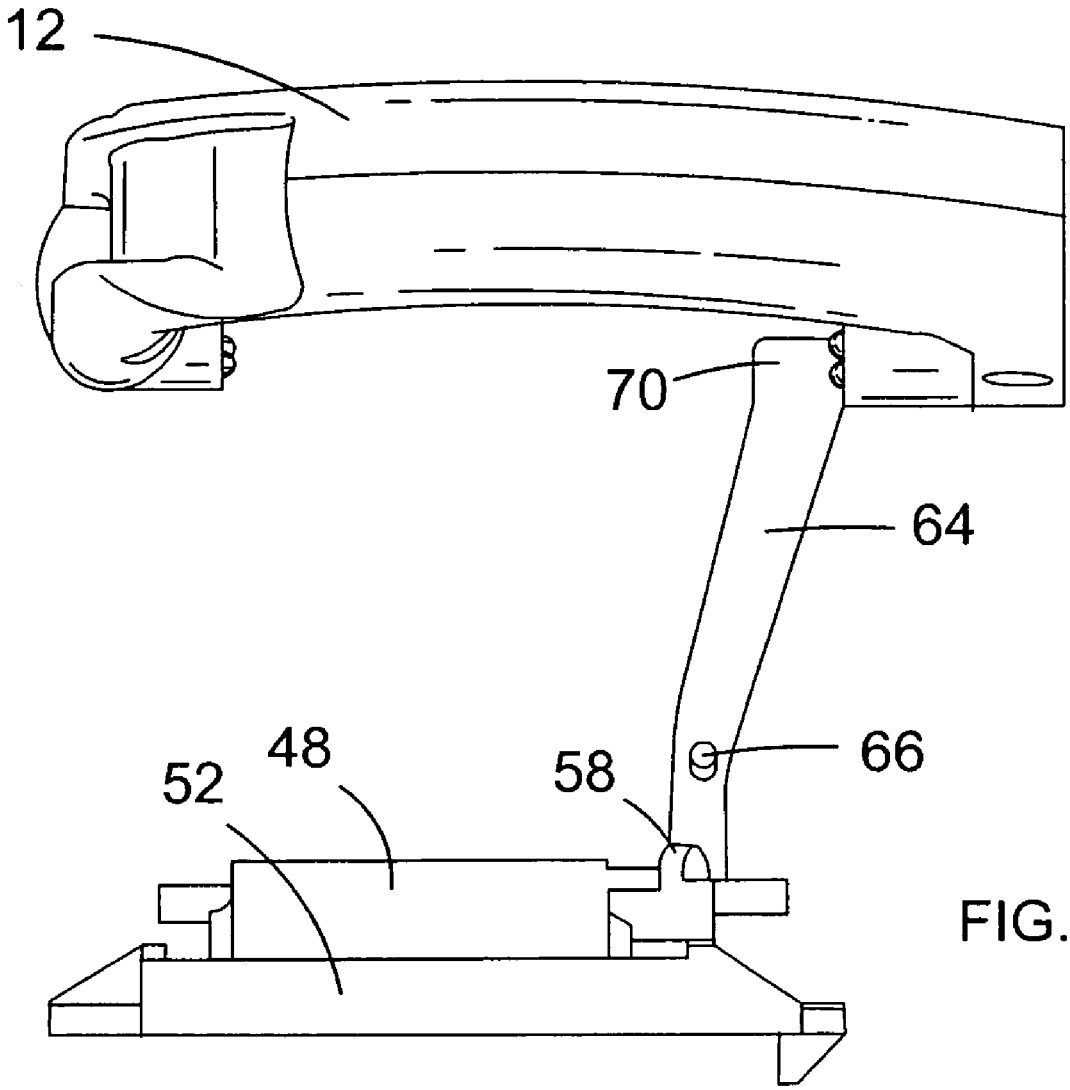
FIG. 15 is a front view of the handle, guard and locking mechanism of FIG. 12.
Figure 16:
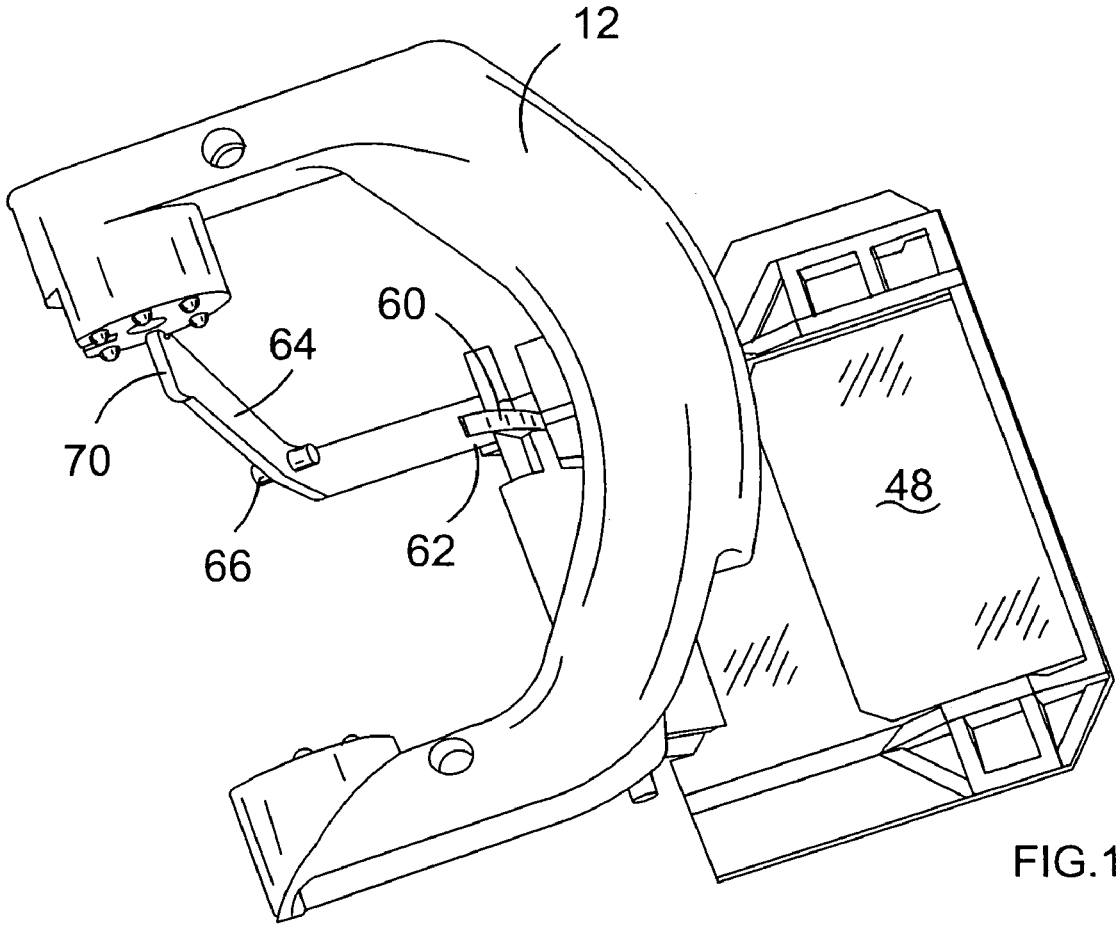
FIG. 16 is a top view of the handle, guard and locking mechanism of FIG. 12.
Figure 17:
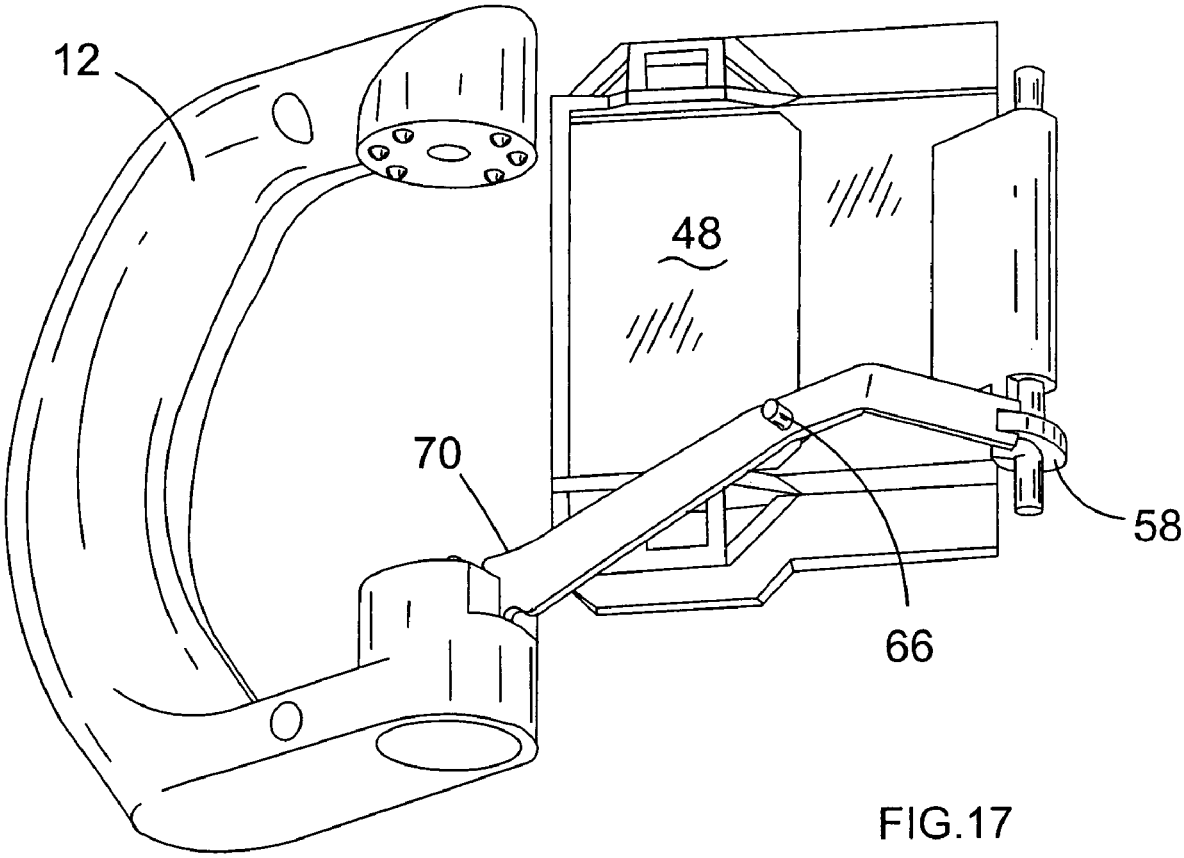
FIG. 17 is a rear view of the handle, guard and locking mechanism of FIG. 14.

A rear part 56 of the guard 48 has a cam 58 (FIG. 13) having a cam surface 60 on a side thereof which cooperates with a side surface of an end 62 of a linkage member 64 mounted to a pivot 66. As a result, movement of the guard 48 from its lower to its upper position causes the cam surface 60 to displace end 62 of the linkage member 64 to the left in FIG. 13, which then urges the linkage member 64 in a clockwise direction about the pivot 66 in the direction of arrow C in FIG. 13. The linkage member 64 is received in a slot 68 in the handle 12 when the guard 48 is in its upper position and when the handle 12 is pivoted upwardly relative to the housing 4 as shown in FIG. 13 to allow the guard 48 to pivot to its raised position. However, the linkage member 64 is prevented from pivoting in the direction of arrow C when its upper end 70 is not aligned with slot 68, which in turn prevents the guard 48 from being raised when the handle 12 is in its lowered position as shown in FIG. 12. Similarly, location of upper part 70 of linkage member in slot 68 when the guard 48 is in its raised position prevents rotation of the handle 12 relative to the housing 4, as a result of which the handle 12 can not be pivoted to its lowered position when the guard 48 is raised. This minimises the risk of injury to a user's hand through inadvertent contact with the upper sanding surface 42 when the handle 12 is in its lowered position as shown in FIG. 9. Suitable means (not shown) may be provided to retain the guard 48 in its raised or lowered position when the handle 12 is in its raised position to keep the guard 48 stationary during use.

The operation of the sander 2 will now be described.

In normal use of the sander 2, i.e. in which sanding is carried out by means of the lower sanding surface 40, the guard 48 covers the upper sanding surface 42, and the handle 12 is locked in any one of its permitted angular positions about axis 14 relative to the housing by means of the locking lever 16. The user actuates the motor by pressing trigger 10 on handle 8, as a result of which the motor 22 drives rear roller 32 to cause movement of the sanding belt 38 around front 34 and rear 32 rollers and upper 40 and lower 42 sanding surfaces in the direction of arrow D shown in FIG. 9. At the same time, rotation of the fan creates an air current entering inlet 20. This causes air containing dust produced by the belt 38 at lower sanding surface 40 to be drawn into inlet 20 as the belt 38 enters inlet 20 to pass around the rear roller 32, and the dust containing air then passes along duct 18 into the dirty side of the fan and is expelled through outlet 28 into the dust bag (not shown).

Because the forwardmost part of the lower sanding surface 40 is defined by the lowermost 36 part of the front roller 34, only that part of the sander 2 forwardly of the rotation axis of the front roller 34 lies above the forwardmost part of the lower sanding surface 40. As a result, the sander 2 can be used to sand much closer to the edge of floors than is the case with conventional sanders. In particular, by minimizing the diameter of front roller 34 while still maintaining a transverse width of 75 mm for the belt receiving path and providing for the use of standard size belt loops, the present invention provides the material removal capabilities of a full size belt sander but allows sanding much closer to a vertical wall. To minimize the gap between the sanding border and such a wall, front roller 34 may have a maximum diameter of approximately 23 mm and preferably a diameter of 16.5 mm. This structure allows the sander to sand within 15 mm of the vertical wall. Including base surface 6, this structure allows the sanding belt to contact the sanded surface for a length of approximately 195 mm along the major axis. Contact between the front part 54 of the sanding belt 38 and a vertical surface such as a wall (not shown) is prevented by the front portion 52 of the guard 48, which extends forwardly of the front part 54 of the belt 38 by approximately 5 mm when the guard 48 is in its lower position. This prevents inadvertent damage to, for example, skirting boards at the edge of a floor to be sanded.

In order to use the upper sanding surface 42, the locking lever 16 is pivoted outwardly of the housing 4 to enable pivoting of the handle 12 about axis 14, and the handle 12 is pivoted to its upper position, as a result of which the upper part 70 of linkage member 64 is aligned with slot 68 in the handle 12 to allow the linkage member 64 to pivot about pivot 66. The guard 48 is then pivoted upwardly by means of a suitable actuator member (not shown), for example a lever located adjacent pivot axis 50 to expose the upper sanding surface 42. The guard 48 is then retained in its upper position by suitable means.

The sander of the present invention also allows for sanding beneath an overhanging edge. The upper surface of base 5 has a forwardly downward inclination. Undersurface 43 has a corresponding downward inclination. This inclination along with the relatively flat upper surface of housing 4 disposed forwardly of motor receiving chamber 41, and the fact that no portion of the housing extends above this flat upper surface permits the forward end of sander 2 to pass readily beneath an overhanging edge. This structure along with the minimized diameter of front roller 34 allows sanding of a horizontal surface to nearly the edge of such a surface extending beneath the overhanging edge. The flat upper surface may extend approximately 64 mm in the rearward direction from the forward end of housing 4, and throughout its extent, the flat upper surface is disposed no greater than approximately 36 mm above the lower sanding surface, with no other portion of the housing disposed or extending above the flat upper surface.

The diameter of rear roller 32 approximately corresponds to the height of base 5 at the rear edge thereof. The rear roller 32 may have a diameter which is in a range of 2–3 times the diameter of front roller 34. Preferrably the diameter of rear roller 32 is 48 mm, or approximately 3 times the front roller 34. In a preferred embodiment, the flat upper surface of housing 4 is formed by the upper surface of guard 48.

When the sanding belt 38 becomes worn, the lever 46 is pivoted outwardly of the housing 4 to compress the compression spring (not shown). This allows support 44 to be moved rearwardly, as a result of which the belt 38 becomes slack and can more easily be removed for replacement. When a replacement belt 38 has been placed around the rollers 32,34, the lever 46 is then pivoted inwardly to cause the spring to urge the forward roller 34 forwards to place the replacement belt 38 under tension.

With further reference to FIG. 2, housing 4 includes a rear flat upper surface extending rearwardly from motor receiving chamber 41, preferably for a distance of at least 50 mm. Housing 4 then curves downwardly about rear roller 32, and handle support portion 45 extends rearwardly therefrom. Rear handle 8 extends rearwardly from motor receiving chamber 41 and terminates at support portion 45. Therefore, a gripping surface of handle 8 extends above rear roller 32, providing increased control for belt sander 2. Trigger 10 is disposed at the underside of the gripping surface of handle 8. The maximum height of sander 2 at the location of the rear flat upper surface may be 68 mm.

It will be appreciated by persons skilled in the art that the above embodiment has been described by way of example only and not in any limitative sense, and that various alterations and modifications are possible without departure from the scope of the invention as defined by the appended claims.

The invention claimed is:

1. A sanding apparatus comprising:

a housing defining a first base surface and a second base surface opposite said first base surface;

at least one first roller and at least one second roller, wherein at least one said first roller has a diameter larger than a diameter of at least one said second roller;

a motor driving at least one said first roller for causing an endless abrasive belt passing around at least one said first roller and at least one said second roller in use to move across said first and second base surfaces to define first and second sanding surfaces respectively;

at least one guard member moveable between a first guard position preventing access to said second sanding surface and at least one second guard position allowing access to said second sanding surface; and at least one handle on said housing, wherein at least one said handle is moveable between a first handle position adjacent said second sanding surface and at least one second handle position further from said second sanding surface than said first handle position.

2. An apparatus according to claim 1, wherein at least one said handle is pivotable between said first and second guard positions thereof.

3. An apparatus according to claim 2, wherein at least one said handle is pivotable relative to said first and second handle positions thereof.

4. An apparatus according to claim 3, wherein the locking means for preventing movement of at least one said handle to the first handle position thereof causes movement of at least one said guard member to the first guard position thereof.

5. An apparatus according to claim 4, wherein the locking means comprises at least one linkage member adapted to engage a respective handle to prevent movement of said handle position thereof.

6. An apparatus according to claim 5, wherein at least one said linkage member comprises a respective protrusion to engage a corresponding slot on a respective said handle.

7. An apparatus according to claim 3, wherein at least one linkage member adapted to engage a corresponding slot on a respective said handle.

8. An apparatus according to claim 7, wherein the locking means comprises at least one linkage member adapted to engage at least one guard member.

9. An apparatus according to claim 5, wherein at least one said linkage member is pivotable relative to the housing between a first position allowing movement of at least one said guard member to a second guard position thereof and a second position preventing movement of said guard member to said second guard position, wherein movement of said linkage member to said first position is prevented when said handle is in a first handle position thereof.

10. An apparatus according to claim 1, wherein at least one said linkage member is substantially tangential to a second roller.

11. An apparatus according to claim 10, wherein a plane defined by said first base surface is adjustable.

12. An apparatus according to claim 11, wherein the predetermined second roller from said first base surface is adjustable.

13. An apparatus according to claim 10 wherein the second roller is displaceable towards said first base surface to facilitate mounting and removal of said endless belt.

14. An apparatus according to claim 1, wherein an upper tangent of said first roller is coincident with said second base surface and a lower tangent of said first roller is not coincident with said first base surface.

15. A power sander comprising:

a housing, said housing comprising an upper portion and a lower wedge-shaped sanding base extending along a major axis, said upper portion including a motor receiving chamber disposed above said sanding base and an undersurface, said sanding base including a lower sanding surface;

a rear roller disposed rearwardly of said sanding base and a front roller disposed forwardly of said sanding base, said rear roller having a larger diameter than said front roller, said front roller, said rear roller and said sanding base jointly defining a path for receiving an endless sanding belt, said motor receiving chamber disposed at a higher vertical position relative to said lower sanding surface than both said front roller and said rear roller and between the locations of said front roller and said rear roller along the major axis, said upper portion undersurface extending at a forwardly downwardly inclined angle from a location above said rear roller towards said front roller; and a motor disposed within said motor receiving chamber.

16. The sander recited in claim 15, said motor having an output shaft, said shaft having a rotation axis which is disposed substantially transversely to the major axis.

17. The sander recited in claim 15, said housing further including a guard pivotably mounted to the forward end of said upper portion, said guard disposed above a forward portion of said base, said guard pivotable upwardly about an axis which extends transversely to the major axis to expose a portion of said sanding belt above said base.

18. The sander recited in claim 15, said housing further including a handle extending rearwardly from said motor receiving portion, said handle including a gripping surface disposed above said rear roller.

19. The sander recited in claim 18, said upper portion including a curved rear portion which extends rearwardly downward, rearwardly of said rear roller, a handle support element extending rearwardly from said curved rear portion, said handle extending between said motor receiving portion and said handle support element.

20. The sander recited in claim 15, said housing further including a handle mounted to said motor receiving chamber and extending transversely to the major axis of said base.

21. The sander recited in claim 20, said handle pivotable about an axis which extends substantially transversely to the major axis of said base.

22. The sander recited in claim 15, said motor receiving chamber comprising a substantially cylindrical chamber, said upper portion including a substantially flat portion extending rearwardly from said chamber.

23. A power sander comprising:

a base having a lower sanding surface extending along a major axis;

a rear roller disposed rearward of said base and a front roller disposed forward of said base, said rear roller having a larger diameter than said front roller;

a housing having an undersurface extending at a forwardly downwardly inclined angle from a location above said rear roller towards said front roller, an open space defined between said undersurface and said base such that an endless loop of sandpaper may be received about said front roller, said rear roller and said base;

a first gripping handle disposed above said rear roller and extending substantially parallel to the major axis from a location rearward of said rear roller to a location forward of said rear roller; and a second gripping handle extending substantially transversely to the major axis and disposed at a higher vertical location relative to said sanding surface than both said front roller and said rear roller and between the locations of said front roller and said rear roller along the major axis.

24. The sander recited in claim 23, said housing further including a guard pivotably mounted to the forward end of said upper portion, said guard disposed above a forward portion of said base, said guard pivotable upwardly about an axis which extends transversely to the major axis to expose a portion of said sanding belt above said base.

25. A power belt sander comprising:

a housing, said housing comprising an upper portion and a lower wedge-shaped sanding base extending along a major axis, said sanding base including a lower sanding surface;

a rear roller disposed rearwardly of said sanding base and a front roller disposed forwardly of said sanding base, said rear roller having a larger diameter than said front roller, said front roller, said rear roller and said sanding base jointly defining a path for receiving an endless sanding belt having a width of approximately 75 mm in a direction transverse to the major axis, said upper portion undersurface extending at a forwardly downwardly inclined angle from a location above said rear roller towards said front roller, said front roller having a diameter which is no greater than approximately 23 mm; and a motor.

26. The sander recited in claim 25, said front roller having a diameter of approximately 16.5 mm.

27. A power belt sander comprising:

a base having a lower sanding surface having a major axis;

a rear roller disposed rearward of said base and a front roller disposed forward of said base, said rear roller having a larger diameter than said front roller;

a housing having an undersurface extending at a forwardly downwardly inclined angle from a location above said rear roller towards said front roller, an open space defined between said undersurface and said base such that an endless loop of sandpaper may be received about said front roller, said rear roller and said base; wherein, said front roller, said rear roller and said sanding base jointly define a path for receiving an endless sanding belt having a width of approximately 75 mm in a direction transverse to the major axis, said housing and said rollers configured so as to allow said sanding belt to sand a horizontal surface within 15 mm of a vertical wall extending up from said horizontal surface.

28. The power sander recited in claim 27, said rear roller having a diameter which is at least 2.5 times the diameter of the front roller.

29. The power sander recited in claim 28, said rear roller having a diameter of approximately 3 times the diameter of the front roller.

30. The power sander recited in claim 27, said sander further comprising a gripping handle extending substantially transversely to the major axis and disposed between the locations of said front roller and said rear roller along the major axis.

31. A power sander comprising:

a housing, said housing comprising an upper portion and a lower wedge-shaped sanding base extending along a major axis, said upper portion overlying substantially all of said sanding base, said upper portion including a motor receiving chamber and a substantially flat surface portion disposed forwardly of said motor receiving chamber, said sanding base including a lower sanding surface;

a rear roller disposed rearwardly of said sanding base and a front roller disposed forwardly of said sanding base, said rear roller and said sanding base jointly defining a path for receiving an endless sanding belt, said flat surface portion inclined downwardly from said motor receiving chamber towards said front roller; and a motor disposed within said motor receiving chamber.

32. The sander recited in claim 31, said flat surface portion extending no greater than approximately 36 mm above the lower sanding surface throughout a region of said flat surface portion which extends rearwardly from a forward edge for a distance of approximately 64 mm.

33. The sander recited in claim 32, said flat surface portion comprising a guard which is pivotable relative to the remainder of said housing.

34. The sander recited in claim 31, said rear roller having a greater diameter than said front roller.

* * * * *